US008834136B2

(12) United States Patent
Drevet

(10) Patent No.: US 8,834,136 B2
(45) Date of Patent: Sep. 16, 2014

(54) CRINKLE DIAPHRAGM PUMP

(75) Inventor: Jean-Baptiste Drevet, Paris (FR)

(73) Assignee: AMS R&D SAS, Venette (FR)

( * ) Notice: Subject to any disclaimer, the term of this patent is extended or adjusted under 35 U.S.C. 154(b) by 389 days.

(21) Appl. No.: 13/056,577

(22) PCT Filed: Jul. 24, 2009

(86) PCT No.: PCT/FR2009/000921

§ 371 (c)(1),
(2), (4) Date: Jan. 28, 2011

(87) PCT Pub. No.: WO2010/012889

PCT Pub. Date: Feb. 4, 2010

(65) Prior Publication Data

US 2011/0176945 A1 Jul. 21, 2011

(30) Foreign Application Priority Data

Aug. 1, 2008 (FR) ..... 08 04389

(51) Int. Cl.
*F04B 43/02* (2006.01)

(52) U.S. Cl.
CPC ..... *F04B 43/02* (2013.01)
USPC ..... 417/413.1; 417/395

(58) Field of Classification Search
CPC ..... F04B 43/02
USPC ..... 417/395, 413.1
See application file for complete search history.

(56) References Cited

U.S. PATENT DOCUMENTS

2001/0001278 A1* 5/2001 Drevet ..... 417/222.2
2008/0232987 A1* 9/2008 Drevet ..... 417/478

FOREIGN PATENT DOCUMENTS

| | | |
|---|---|---|
| EP | 0 267 041 | 5/1988 |
| EP | 0 412 856 | 2/1991 |
| FR | 2 861 910 | 5/2005 |
| FR | 2 905 147 | 2/2008 |
| WO | WO 2007063206 A1 * | 6/2007 |

* cited by examiner

*Primary Examiner* — Charles Freay
*Assistant Examiner* — Philip Stimpert
(74) *Attorney, Agent, or Firm* — Muncy, Geissler, Olds & Lowe, P.C.

(57) ABSTRACT

An undulating diaphragm pump having a propulsion chamber for receiving said diaphragm, wherein the diaphragm has mechanical characteristics that vary from an inlet of the propulsion chamber towards an outlet of the propulsion chamber in such a manner that, when the diaphragm is actuated to deform with a traveling wave that propagates from the inlet towards the outlet of the propulsion chamber in order to propel the fluid, the propagation speed of the wave in the diaphragm in any cross-section relative to the movement of the fluid inside the propulsion chamber is equal to or greater than the mean travel speed of the fluid in said section.

9 Claims, 4 Drawing Sheets

CRINKLE DIAPHRAGM PUMP

The invention relates to an improved undulating diaphragm pump.

BACKGROUND OF THE INVENTION

Pumps are known, e.g. from document FR 2 744 769, that have a diaphragm mounted in a propulsion chamber so as to undulate under drive from at least one linear electromagnetic actuator between two end plates that define a chamber for propelling fluid from an inlet of the pump towards an outlet of the pump.

The movable portion of the actuator is generally directly coupled to an outer edge of the diaphragm extending beside the inlet of the propulsion chamber and it imparts transverse oscillation to the outer edge of the diaphragm, thereby causing the diaphragm to undulate perpendicularly to its plane. The effect of coupling between the undulations and the fluid is to propel the fluid from the inlet towards the outlet of the propulsion chamber.

In general, the flow section for fluid in the propulsion chamber decreases from the inlet of the propulsion chamber towards the outlet of the pump, thus giving rise, because of flow rate conservation, to an acceleration of the fluid and thus to an increase in the mean speed of the fluid as measured in each cross-section of the propulsion chamber, which speed increases progressively from the inlet towards the outlet of the propulsion chamber.

OBJECT OF THE INVENTION

The invention seeks to propose a diaphragm pump that makes greater efficiency possible.

BRIEF DESCRIPTION OF THE INVENTION

In order to achieve this object, the invention provides an undulating diaphragm pump having a propulsion chamber for receiving said diaphragm, the diaphragm having mechanical characteristics that vary from an inlet of the propulsion chamber towards an outlet of the propulsion chamber in such a manner that when the diaphragm is actuated to deform with a traveling wave that propagates from the inlet towards the outlet of the propulsion chamber in order to propel the fluid, the propagation speed of the wave in the diaphragm in any cross-section relative to the movement of the fluid inside the propulsion chamber is equal to or greater than the mean travel speed of the fluid in said section.

This ensures that the diaphragm wave advances at all points in the propulsion chamber at a speed that is faster than that of the fluid it is propelling, and that the diaphragm transmits its mechanical energy to the fluid over the entire propagation length of the wave along the diaphragm. The coupling between the undulating diaphragm and the fluid is thus optimized, with the movement of the diaphragm being more efficient, since the entire surface area of the diaphragm is propulsive, thereby improving the efficiency of the pump.

It is thus possible to increase the speed of the fluid at the outlet from the propulsion chamber and to obtain relatively large flow rates, making it possible to decrease the diameter of the diaphragm and the overall size of the pump head. In addition, this makes it possible to avoid any positive transfer of energy from the fluid to the diaphragm which would run the risk of causing the diaphragm to come into contact with the end plates. Such contacts give rise to noise and run the risk of damaging the diaphragm. It is also possible to reduce the pulsations in the pressure and in the flow rate at the outlet from the propulsion chamber.

In a particular embodiment of the invention, the diaphragm has imparted thereto stiffness that varies and that increases going from the inlet towards the outlet of the propulsion chamber. It is known that stiffness is an important parameter for determining the propagation speed of the traveling wave that deforms the diaphragm.

BRIEF DESCRIPTION OF THE DRAWINGS

The invention can be better understood in the light of the accompanying drawings, in which.

DETAILED DESCRIPTION OF THE INVENTION

Figure 1:
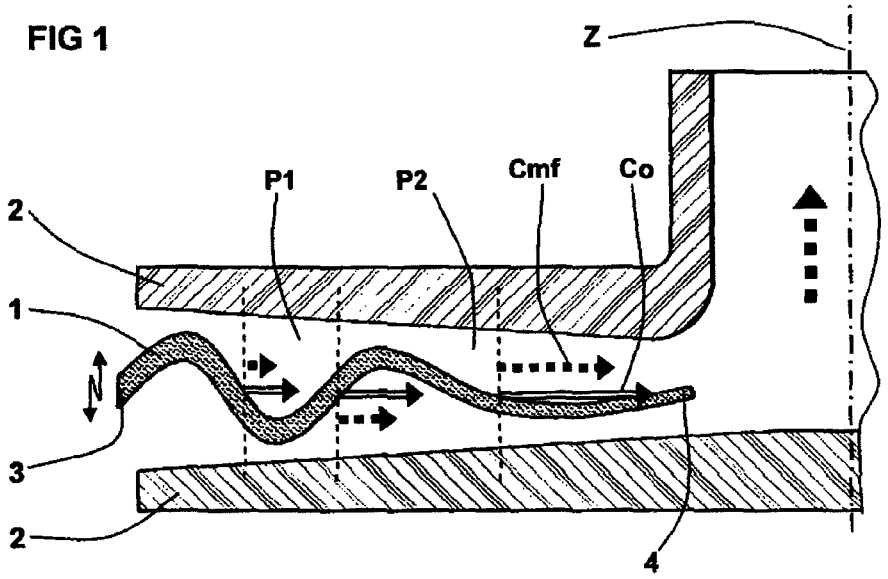
FIG. 1 is a diagrammatic half-view in section of an undulating diaphragm pump of the invention.
Figure 2A:
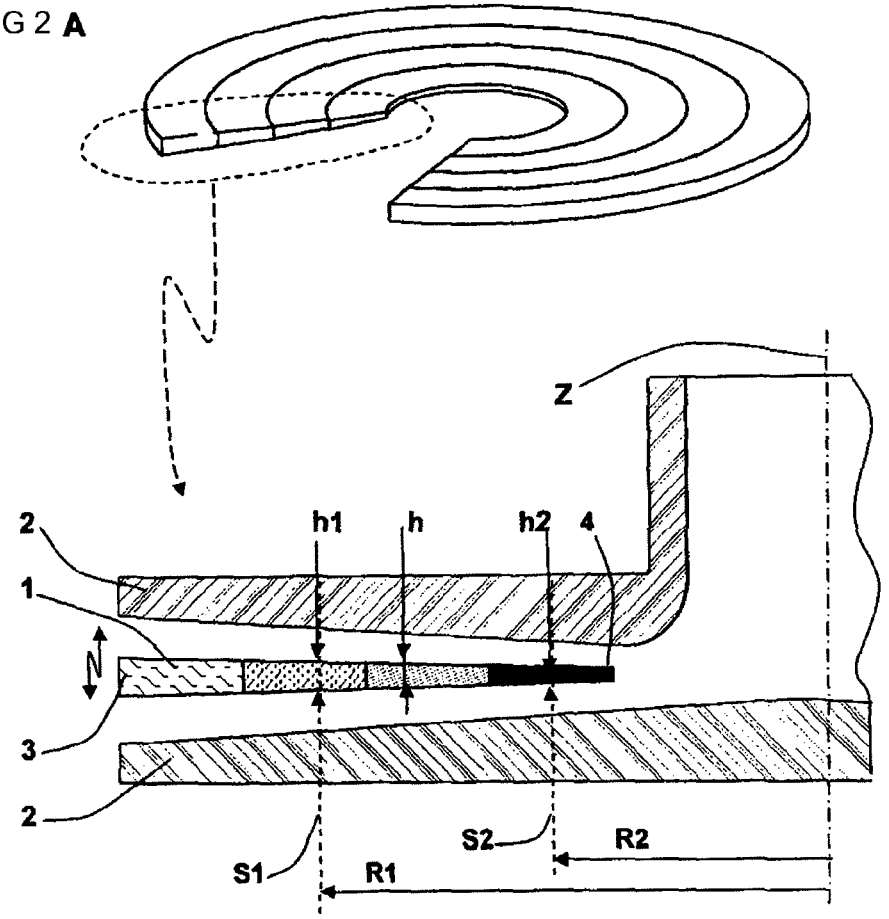
FIGS. 2A, 2B, 2C, and 2D are partially cut-away perspective views of a disk-shaped diaphragm in various particular embodiments of the invention.
Figure 2B:
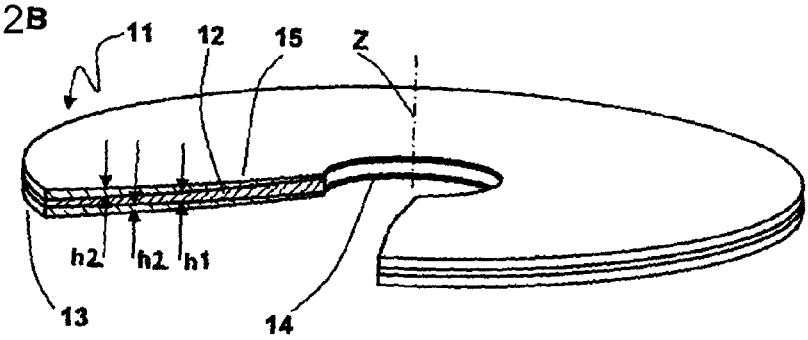
Figure 2C:
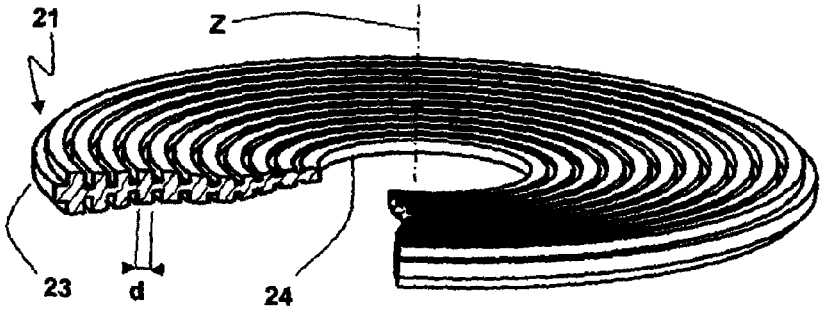
Figure 2D:
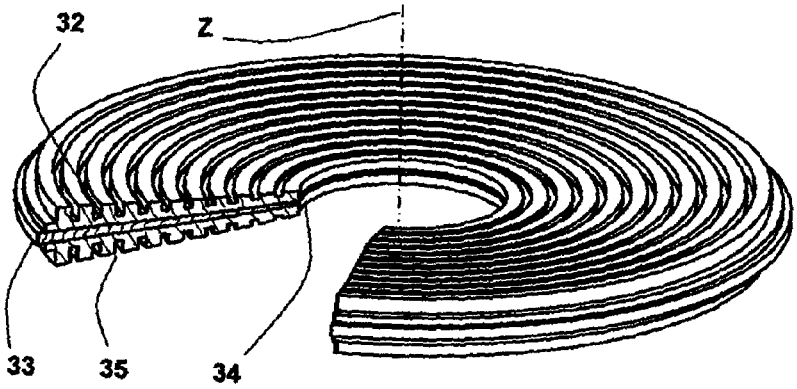

With reference to FIG. 1, the undulating diaphragm pump of the invention comprises a diaphragm that extends between two end plates 2 that constitute a fluid propulsion chamber. An actuator (not shown) is connected to an edge 3 of the diaphragm and actuates the edge 3 of the diaphragm transversely so as to cause the diaphragm to undulate with a traveling wave that propagates from the edge 3 towards the center 4 of the diaphragm. Fluid is thus transferred between the two end plates from an inlet of the propulsion chamber at the periphery thereof towards an outlet of the propulsion chamber situated at the center thereof.

If Z is the axis of revolution of the pump, and if the pump is notionally sectioned on a circular cylinder about the axis Z, it can be seen that the portion of the cylinder that is situated between the end plates 2 defines a working section for passing the fluid, ignoring the section of the diaphragm intersected by the cylinder. Naturally, on coming closer to the center of the diaphragm, the area of the working section decreases because of the decrease in the radius of the cylinder, and also because the two end plates come closer together. For an incompressible fluid such as a liquid, the law of flow rate conservation between the inlet and the outlet of the propulsion chamber causes the mean flow speed of the fluid through the various working sections to increase in proportion to the decrease in the area of the working section.

The invention seeks to propose a diaphragm that takes account of this variation in the mean speed of the fluid between the inlet and the outlet of the fluid propulsion chamber.

With reference to FIG. 1, the fluid flow sections lie between the diaphragm and the end plates, and the crests of the waves form constrictions in section that advance at the propagation speed of the wave. The pressure difference between the pressure P1 upstream from a constriction and the pressure P2 downstream from the constriction depends on the speed difference between the propagation speed of the wave and the mean speed of the fluid. The product of this pressure difference (P1−P2) multiplied by the mean flow rate in said section corresponds to the hydraulic power that is locally transmitted to the fluid.

Maintaining a positive speed difference throughout the cross-section of the propulsion chamber makes it possible to guarantee positive power transmission to the fluid over the entire propagation length of the wave along the diaphragm, i.e. over the entire active radius of the diaphragm in this example.

Thus, wave conditions establish a series of constrictions and pressure differences that extend from the inlet pressure to the outlet pressure of the propulsion chamber. The difference between the inlet pressure and the outlet pressure multiplied by the mean flow rate corresponds to the mean hydraulic power transmitted to the fluid. In this example it is ensured that the diaphragm transmits its mechanical energy to the fluid over its entire active radius, with a traveling wave in the diaphragm propagating throughout the cross-section of the propulsion chamber at a speed that is faster than the speed with which the fluid travels through said section of the propulsion chamber.

In the particular embodiment given reference A in FIG. 2, the diaphragm 1 is made up for this purpose of concentric annular portions that are made of materials that have different moduluses of elasticity and that are disposed in such a manner that the modulus of elasticity E of the material of the diaphragm increases from the peripheral edge 3 of the diaphragm going towards the center 4 of the diaphragm more quickly than the thickness h of the diaphragm decreases. The variation in the modulus of elasticity E is represented symbolically by a succession of annular zones, naturally constituted in the detail view solely by their sections in the section plane. Thus, the product Exh measured in a cross-section increases continuously going from the edge 3 towards the center 4 so that the propagation speed of the traveling wave that deforms the diaphragm 1 in operation increases continuously.

In FIG. 2, it can be seen that the cylinder of radius R1 defines a working flow section S1 (of circular cylindrical shape) for the fluid and that the cylinder of radius R2 defines a working flow section S2 (likewise of circularly cylindrical shape) for the fluid, the areas of these two sections being in the ratio $(R2/R1)^2 \times h2/h1$, where h1 and h2 are the heights between the end plates at the sections S1 and S2 respectively. The area of the section S2 is thus considerably smaller than the area of the section S1, and the speed of the fluid in the section S2 is thus greater than the speed of the fluid in the section S1.

It is appropriate to ensure that the variation in the product Exh, which is one of the important parameters determining the propagation speed of the traveling wave that deforms the diaphragm, varies sufficiently quickly to ensure that the propagation speed is always higher than the mean speed of the fluid, or indeed increases faster than the speed of the fluid on approaching the center of the propulsion chamber.

If this condition is satisfied, then the diaphragm transmits its mechanical energy to the fluid over the entire propagation length of the wave along the diaphragm, i.e. along the entire active radius of the diaphragm.

With reference to the embodiment referenced B, the diaphragm 11 is made out of two materials: a core 12 out of a material having a large modulus of elasticity E1 and of thickness h1 that is constant or that increases as shown going from the edge 13 towards the center 14, and a covering 15 that extends on either side of the core 12 and that is made of a material having a lower modulus of elasticity E2 and of thickness 2×h2 that decreases from the edge 13 towards the center 14. The assembly is made in such a manner that the quantity $$E1 \times h1 + E2 \times 2 \times h2$$

increases from the edge 13 towards the center 14 sufficiently to impart a propagation speed to the traveling wave that deforms the diaphragm 12 such that the propagation speed increases more quickly than the decrease in the working section for fluid flow. With reference to the embodiment referenced C, the diaphragm 21 is constituted by a material that is homogeneous. It is cut into the shape of a disk of thickness h that is generally decreasing from the edge towards the center, and in which annular grooves are formed at intervals that are regular in this example so as to leave a core that is of thickness that is constant in this example. The density of the material is written ρ and the density per unit area of the diaphragm is equal to the product ρ×h, with the grooves being arranged in such a manner that the mean of the quantity ρ×h over a distance d including a trough and a ridge decreases on approaching the center, such that this technical configuration also gives rise to progressive variation in the propagation speed of the wave.

With reference to another embodiment referenced D, the diaphragm 31 comprises a core 32 made of a material having a large modulus of elasticity E1 and a constant thickness h1, together with a covering 35 made of a material having a small modulus of elasticity E2 and presenting annular grooves as in the above-described embodiment.

Figure 3:
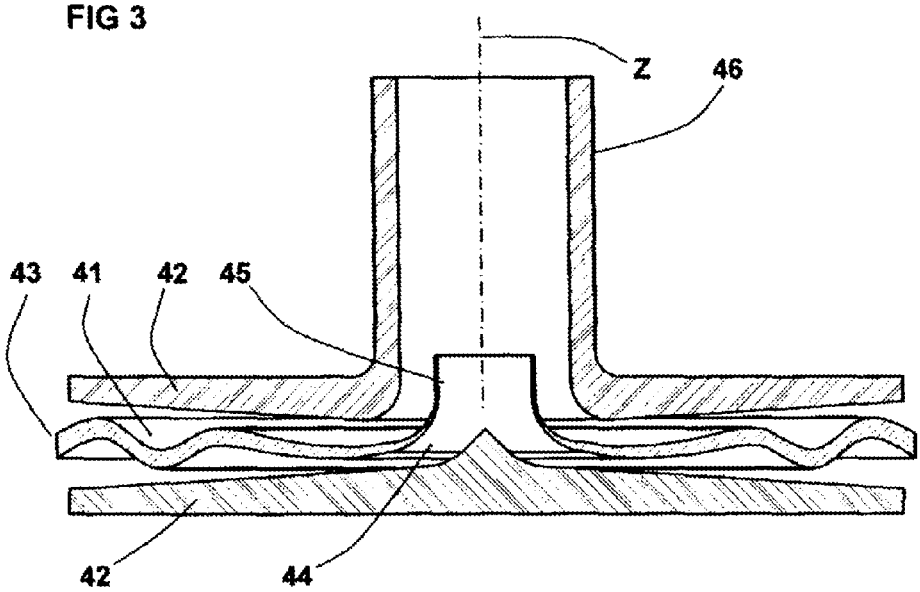
FIG. 3 is a section view of an undulating diaphragm pump fitted with a diaphragm having a neck in another particular embodiment of the invention.

In yet another embodiment, as shown in FIG. 3, the diaphragm 41 includes a neck 45 at its center, the neck extending along the axis Z into the delivery duct 46 at the outlet from the propulsion chamber. The neck 45 forms a stiffener that contributes to increasing the stiffness of the diaphragm towards its center 44, such that the propagation speed of the traveling wave increases.

In addition, the neck 45 offsets the point where the fluid flows on either side of the diaphragm 41 join together to outside the propulsion chamber, and it makes use of the dynamic pressure of the fluid at the outlet from the neck so as to conserve a pressure differential between the faces of the diaphragm in its central portion inside the propulsion chamber. The central portion of the diaphragm thus works under better conditions, and the efficiency of the pump is thus improved.

Figure 5:
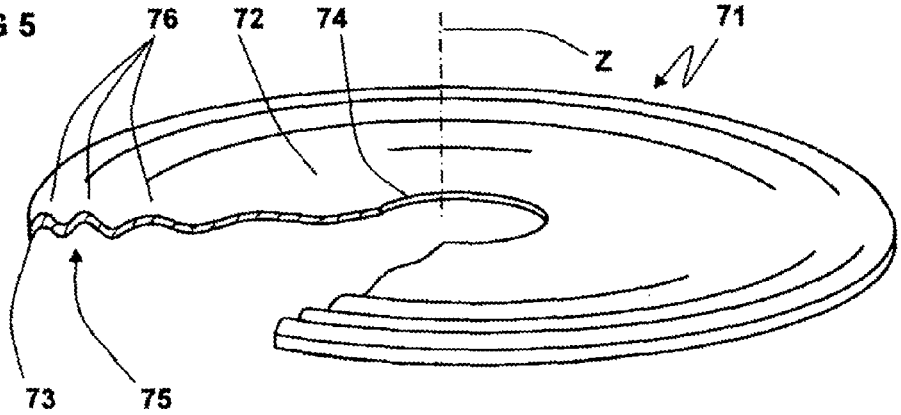

In FIG. 5, the diaphragm 71 comprises a core 72 made of a material having a large modulus of elasticity and presenting in the vicinity of its edge 73 a peripheral zone 75 that is made more flexible by having a profile in the form of wavelets 76 that make the diaphragm 71 more flexible in the vicinity of its edge 73.

Figure 6:
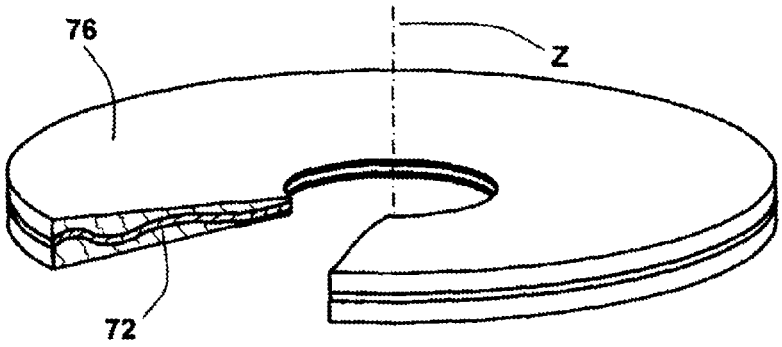

In FIG. 6, the core 72 is embedded in a layer 76 of flexible material that forms a covering.

Figure 7:
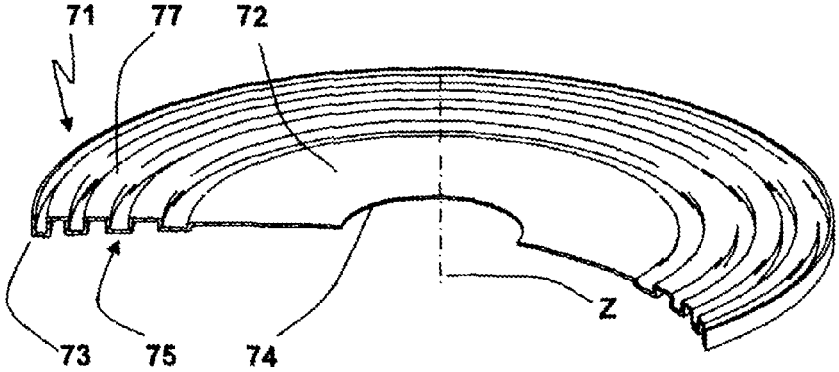

In the embodiment of FIG. 7, the diaphragm 71 comprises a core 72 made of a material having a large modulus of elasticity that is provided in the vicinity of its edge 73 with a flexible peripheral zone 75 presenting a profile of crenellations 77 imparting flexibility to the vicinity of the edge 73.

As can be understood from the above, the above-described embodiments relate to diaphragms forming bodies of revolution and having mechanical characteristics that are constant along any circle centered on the central axis Z, even though those characteristics vary radially going from the edge towards the center.

Figure 4:
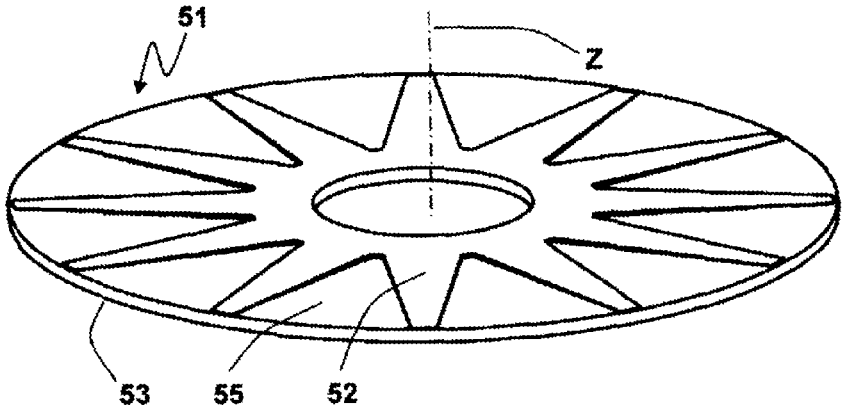
FIGS. 4, 5, 6, 7, and 8 are perspective views of diaphragms in other particular embodiments of the invention.

Nevertheless, it is possible while remaining within the ambit of the invention, to provide diaphragms in which the mechanical characteristics vary radially, but are not necessarily constant around a circle. Thus, as in the embodiment shown in FIG. 4, the diaphragm 51 may be made in composite manner with a star-shaped stiffener 52 made of a material having a large modulus of elasticity, comprising a central ring from which branches project. The stiffener 52 is incorporated in a web 55 made of a material having a small modulus of elasticity. In the same manner as described above, this type of diaphragm enables a traveling wave starting from the edge 53 and going towards the center 54 to propagate at a speed that increases.

Figure 8:
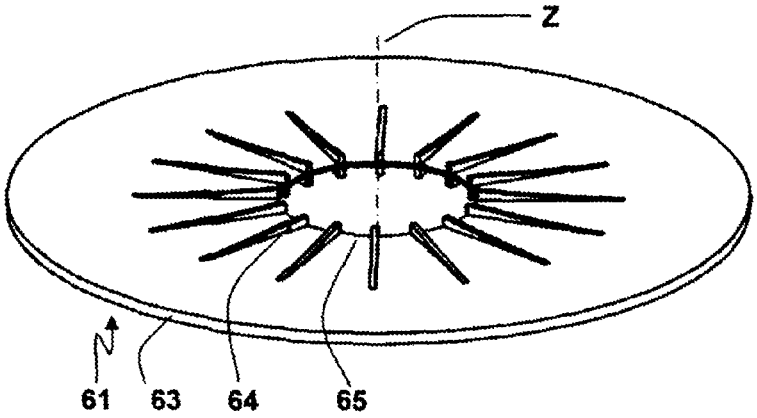

In the embodiment of FIG. 8, the diaphragm 61 comprises a core 62 carrying ribs 65 that extend radially from the center 64 of the diaphragm 61 towards the edge 63 as far as a middle portion of the diaphragm 61 between the center 64 and the edge 63. The ribs 65 are of decreasing height such that the ribs 65 present a maximum height close to the center 64 and zero height in the middle portion.

The core 62 is made of a material that is relatively flexible and that is stiffened progressively by the ribs 65 going towards the center 64.

The core 62 may optionally be covered by a covering so that the diaphragm presents faces that are plane.

The invention is not limited to the description above, but on the contrary covers any variant coming within the ambit defined by the claims.

In particular, although the invention is described with reference to diaphragms that are disk-shaped, it is clear that the invention applies equally well to diaphragms that are strip-shaped or that are tubular. It should be observed that in pumps that use diaphragms of this type, the working section for fluid flow through the propulsion chamber decreases only because the two end plates come closer together and possibly also because the diaphragm becomes thicker, but at a rate that is slower than in pumps having disk-shaped diaphragms of the kind described above. The variation in speed between the inlet and the outlet of the propulsion chamber is thus less marked. As a result, the variation in the mechanical characteristics of the diaphragm for causing the propagation speed of the wave in the diaphragm at all cross-sections relative to fluid flow inside the propulsion chamber to be equal to or greater than the travel speed of the fluid in said section takes place more slowly and it is therefore easier to implement.

In a variant, the modulus of elasticity E of the diaphragm may vary more slowly than the thickness of the diaphragm decreases, but the performance of the pump will nevertheless be diminished compared with the embodiment described.

In a variant, diaphragm may be made of a single material that is treated locally so as to obtain variation in its modulus of elasticity (the treatment may be hot deformation, particle bombardment, local doping, . . . ).

What is claimed is:

1. An undulating diaphragm pump having a propulsion chamber for receiving a diaphragm, wherein the diaphragm has mechanical characteristics that vary from an inlet of the propulsion chamber towards an outlet of the propulsion chamber in such a manner that when said pump is operated, the diaphragm is actuated to deform with a traveling wave that propagates from the inlet towards the outlet of the propulsion chamber in order to propel the fluid and the propagation speed of the wave in the diaphragm in any cross-section relative to the movement of the fluid inside the propulsion chamber is equal to or greater than the mean travel speed of the fluid in said section, and wherein the diaphragm is made out of at least one material so as to have a modulus of elasticity (E) in the material of the diaphragm that increases going from the inlet towards the outlet of the propulsion chamber.

2. The pump according to claim 1, wherein the product of the modulus of elasticity (E) of the material of the diaphragm multiplied by the thickness (h) of the diaphragm increases going from the inlet towards the outlet of the propulsion chamber.

3. An undulating diaphragm pump having a propulsion chamber for receiving a diaphragm, wherein the diaphragm has mechanical characteristics that vary from an inlet of the propulsion chamber towards an outlet of the propulsion chamber in such a manner that when said pump is operated, the diaphragm is actuated to deform with a traveling wave that propagates from the inlet towards the outlet of the propulsion chamber in order to propel the fluid and the propagation speed of the wave in the diaphragm in any cross-section relative to the movement of the fluid inside the propulsion chamber is equal to or greater than the mean travel speed of the fluid in said section, and wherein the diaphragm includes a core of material having a large modulus of elasticity (E1) and having a thickness (h1), and a covering that covers the core and that is made on at least one side of the core out of a material having a small modulus of elasticity (E2) and has a thickness (h2) in such a manner that the sum of the product of the modulus of elasticity (E1) multiplied by the thickness (h1) of the core plus the product of the modulus of elasticity (E2) multiplied by the thickness (h2) of the covering increases going from the inlet towards the outlet of the propulsion chamber.

4. An undulating diaphragm pump having a propulsion chamber for receiving a diaphragm, wherein the diaphragm has mechanical characteristics that vary from an inlet of the propulsion chamber towards an outlet of the propulsion chamber in such a manner that when said pump is operated, the diaphragm is actuated to deform with a traveling wave that propagates from the inlet towards the outlet of the propulsion chamber in order to propel the fluid and the propagation speed of the wave in the diaphragm in any cross-section relative to the movement of the fluid inside the propulsion chamber is equal to or greater than the mean travel speed of the fluid in said section, and wherein the diaphragm has a star-shaped stiffener made of a material having a large modulus of elasticity and comprising a central ring with branches extending therefrom; the stiffener being integrated in a web made of a material having a modulus of elasticity smaller than said large modulus of elasticity.

5. An undulating diaphragm pump having a propulsion chamber for receiving a diaphragm, wherein the diaphragm has mechanical characteristics that vary from an inlet of the propulsion chamber towards an outlet of the propulsion chamber, the diaphragm having a stiffness that varies and that increases going from the inlet towards the outlet of the propulsion chamber.

6. The pump according to claim 5, wherein the diaphragm is constituted by a disk of thickness that decreases from an inlet towards the outlet of the propulsion chamber, with annular grooves formed therein in order to leave a core remaining in said grooves.

7. The pump according to claim 5, wherein the diaphragm extends as a body of revolution and presents a neck at its center that extends around a central axis (Z) of the diaphragm.

8. The pump according to claim 5, wherein the diaphragm includes in the vicinity of its edge beside the inlet of the propulsion chamber a portion that is made flexible, presenting a profile of wavelets or crenellations.

9. The pump according to claim 5, wherein the diaphragm includes in the vicinity of its edge, beside the outlet from the propulsion chamber, a portion that is stiffened by radial ribs of height that increases going towards said edge.

* * * * *